US006576098B2

(12) United States Patent
Knies

(10) Patent No.: US 6,576,098 B2
(45) Date of Patent: Jun. 10, 2003

(54) METAL CATHODE SHEET

(75) Inventor: Gunter Knies, Osnabrück (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 09/931,150

(22) Filed: Aug. 16, 2001

(65) Prior Publication Data

US 2002/0066667 A1 Jun. 6, 2002

(30) Foreign Application Priority Data

Aug. 16, 2000 (DE) ..... 100 39 893

(51) Int. Cl.[7] ..... C25D 1/00

(52) U.S. Cl. ..... 204/281; 204/286.1; 204/288; 204/288.1; 204/289; 204/279

(58) Field of Search ..... 204/279, 281, 204/286.1, 288, 288.1, 289

(56) References Cited

U.S. PATENT DOCUMENTS

| | | | | |
|---|---|---|---|---|
| 5,314,600 A | | 5/1994 | Webb et al. | 204/279 |
| 5,919,343 A | | 7/1999 | Sparapani | 204/286 |
| 6,017,429 A | | 1/2000 | Persson | 204/281 |
| 6,193,862 B1 | * | 2/2001 | Cutmore et al. | 204/281 |
| 6,245,209 B1 | * | 6/2001 | Bill | 204/281 |
| 6,312,573 B1 | * | 11/2001 | Dwyer et al. | 204/279 |

* cited by examiner

*Primary Examiner*—Bruce F. Bell
(74) *Attorney, Agent, or Firm*—Kenyon & Kenyon

(57) ABSTRACT

The present invention relates to a metal cathode sheet as component of cathode equipment for an electrolysis tank for the electrolytic recovery of pure metals, especially copper. The cathode sheet is provided, at its side edges which come into contact with the electrolyte and are vertically aligned in the electrolysis tank, with an edge protector, made of a ceramic material. The edge protector is electrically insulating, of dense porosity and resistant to electrolyte. Sharp-edged breakthroughs and the outer cathode cutting edges are completely coated by edge protector. In this manner flux line concentrations at these locations are forestalled.

12 Claims, 1 Drawing Sheet

METAL CATHODE SHEET

FIELD OF THE INVENTION

The present invention relates to a metal cathode sheet, more particularly a metal cathode sheet having an edge protector.

BACKGROUND OF THE INVENTION

In the refinement of crude metals with the aid of electrolysis for recovering pure metal, the metal is dissolved in an electrolysis tank from the impure anode and deposited in pure form on the cathode. The impurities remain dissolved in the electrolyte or form anode slime.

Various constructions of electrolysis cathodes are counted among the related art. They differ mainly in the choice of material or material combination of bearing rail and metal cathode sheet with a view to relatively good corrosion resistance, mechanical stability, and electrical conductivity for minimizing energy losses.

Typically, the side edges of the cathodes, which are vertically aligned in the electrolysis tank, are provided with an electrically insulating screen as edge protection. This helps to prevent the growing together of the metal layers deposited on both sides of the metal cathode sheet from reaching over the side edges.

In this connection, it is known to coat the side edges with wax. The disadvantage of doing this is, first of all, that a large quantity of wax is required. Furthermore, if the wax is interspersed with contaminating particles, bridge formations with the electrolyte can take place anyway, and this may lead to uncontrolled growth of metal buds whereby the depositing performance drops and the course of the operation is disturbed. Metal cathode sheets are therefore maintained in rotation, and the metal buds are removed. This requires an operating interruption each time.

It is also known to provide the side edges of the metal cathode sheets with edge protection made of plastic.

In the metal cathode sheet known from U.S. Pat. No. 5,314,600, the edge protectors are plastic rails that surround the vertical side edges of the cathode sheet in clamping fashion. On the side edges of the cathode sheet bore holes are provided into which holding pins are fitted, thereby fixing the plastic rails.

The edge protector has a very slack, loose connection to the cathode sheet. This has the disadvantage that electrolyte can penetrate into the edge protector. Then, at the boring edges in the cathode sheet and at the inside sheet cutting edges, high local field densities can appear with the result that, particularly at these locations, uncontrolled metal growth takes place. After longer-term application of the cathode sheet in the electrolyte, the plastic protector can be pried apart and damaged. This causes expensive repair work or possibly a complete renewal of the edge protector.

U.S. Pat. No. 5,919,343 also describes a plastic edge strip for use as an edge protector. The strip is connected to the cathode sheet using plastic pins and fusion welding technique. Nevertheless, non-fused, faulty connection regions can result due to non-observance of construction prerequisites with respect to the parts to be connected, by non-observance of certain welding parameters, as well as by errors in preassembly. These oversites allow the passage of electrolyte and lead to uncontrolled formation of buds at the outer edge. The problem of local flux line concentration at sharp-edged borings in the cathode sheet, with its negative effects, has also not been solved.

U.S. Pat. No. 6,017,429 describes a metal cathode sheet having an electrically insulating edge protector made of plastic resistant to electrolyte. The edge profile is chemically connected to the metal cathode sheet, preferably using an adhesive or a vulcanizing technique.

Also in this particular embodiment, an intimate combination of cathode sheet and edge profile is not absolutely ensured. Thus, penetration by electrolyte under the wall of the edge profile can take place.

SUMMARY OF THE INVENTION

The object of the present invention is to create an improved metal cathode sheet for use under operational conditions. Such a cathode sheet is designed to prevent uncontrolled metal growth at the side edges. Thus, on the one hand, operational interruptions and maintenance work can be reduced and, on the other hand, deposit performance can be increased.

According to the present invention, the object is attained by providing a metal cathode sheet as a component of cathode equipment for an electrolysis tank for the electrolytic recovery of pure metals, especially copper, which is provided, at least at its side edges which come into contact with the electrolyte and are vertically aligned in the electrolysis tank, with an edge protector, wherein the edge protector is made of a ceramic material.

Preferably the edge protector is made of an oxide-ceramic material such as aluminum, zirconium or magnesium oxide. The material has great hardness, strength and insulating capacity. In addition, especially aluminum oxide has very good chemical stability.

The present invention is described in detail below, using an exemplary embodiment represented in the drawings.

DESCRIPTION OF THE PREFERRED EMBODIMENT

Figure 1:
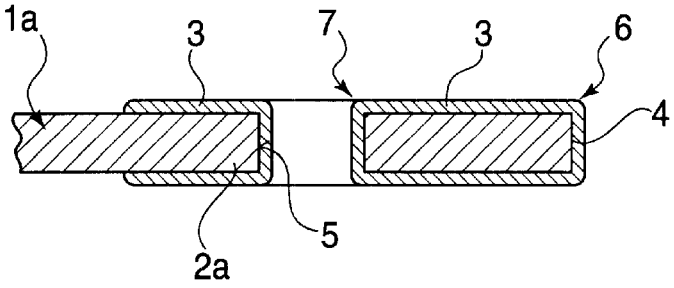
FIG. 1 illustrates a horizontal cross-section through the side edge of a metal cathode sheet according to the present invention.
Figure 2:
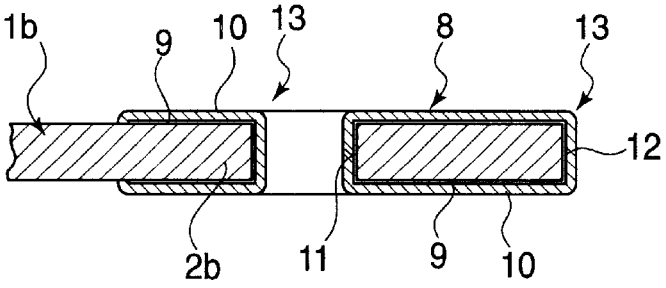
FIG. 2 illustrates a second specific embodiment of a metal cathode sheet in horizontal section through the side edge.
Figure 3:
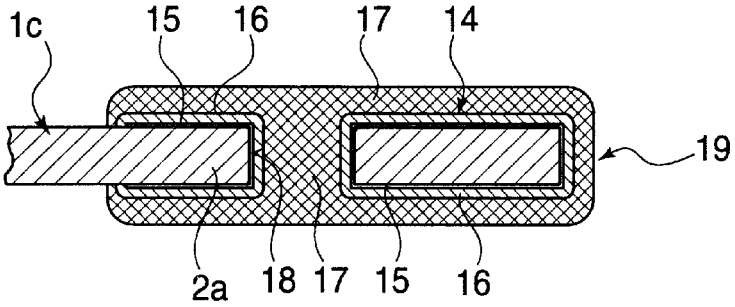
FIG. 3 illustrates the representation of a horizontal section through the side edge of a third specific embodiment.

In FIGS. 1 through 3, three cathode sheets are marked 1*a*, 1*b* and 1*c*, and shown in section respectively through breakthroughs 5,11, and 18. Cathode sheets 1*a*, 1*b*, 1*c* normally have a rectangular cross-sectional configuration. They are advantageously formed from corrosion-resistant stainless steel. The cathode sheets 1*a*, 1*b*, 1*c* are hung, for example, on bearing rails (not shown) made of copper, in an electrolysis tank (not shown) for refining crude copper. In one configuration, the ends of the bearing rails reach current rails running parallel to the electrolysis tank while making electrical contact with the installation.

Cathode sheet 1*a* has on its inside edge 2*a* formed by breakthrough 5, an edge protector 3 made of a ceramic material. Edge protector 3 is applied so that it adheres firmly to side edge 2*a* as a monolayer. Edge protector 3 preferably has a relatively dense porosity. It overlaps the outer cathode edge of cut 4 all-over and completely lines the wall of a breakthrough 5 in cathode sheet 1*a*. It can be seen that the transitions 6, 7 on the cathode edge 4 and at breakthrough 5 are rounded. Thereby local flux line concentrations in these regions can be avoided or strongly suppressed. As such, uncontrolled outgrowth of metal is forestalled.

The specific embodiment seen in FIG. 2 has a ceramic edge protector 8 constructed in two layers. It includes a half layer 9 and a cover layer 10. Half layer 9 functions as adhesive agent and expansion adjuster for compensating changes in length arising from temperature fluctuations. A cover layer 10 is applied on half layer 9. All sharp-edged breakthroughs 11 and the outer cathode edges 12 are completely coated with the electrically insulating ceramic edge protector 8 having rounded transition areas 13.

Preferably, edge protector 8 is developed in several layers—at least two-layered. Further advantages of properties can be achieved by multiple layers, especially an increase in imperviousness to diffusion and an increase in adhesive strength of the edge protector to the cathode sheet.

In one embodiment, edge protector 8 is made of adhesive layer 9 and a covering layer 10. In this connection, a first layer is applied as adhesion promoter and expansion adjustment layer in the form of a single or multiple layer, over which a cover layer is provided. Cover 10 layer can be developed as a single or multiple layer. It is essential for all sharp-edged breakthroughs 11 and the outer cathode edges to be coated completely with electrically insulating ceramic edge protection. Flux line concentrations at these locations are prevented.

It is not essential but expedient to provide support for the edge profile in the region of the cathode sheet's side edges. The supports are preferably executed in the form of borings or breakthroughs in the cathode sheet.

The adhesive layer adheres by a direct interaction of the metal components in the adhesive layer, individual elements in the polymer chain and the stainless steel surface of the cathode sheet.

In cathode sheet 1*c*, seen in FIG. 3, edge protector 14 is also constructed of two layers, a half layer 15 and a ceramic cover layer 16. The edge protector 14 has a jacket 17 made of an electrolyte-resistant plastic. Jacket 17 completely embeds edge protector 14 and is connected to it with non-positive and positive locking. For this purpose, the breakthroughs 18 functioning as support in cathode sheet 1*c* are completely filled with plastic. Outer cathode edge 19 is also embedded in the jacket.

Jacket 17 guarantees impact protection for ceramic edge protector 14 besides guaranteeing an increase in the electrical insulating properties, pore density and resistance to electrolyte. Additionally, the plastic jacket guarantees impact protection which works out effectively during handling of the cathode sheets. This is advantageous especially during handling of cathode sheet 1*c* outside the electrolysis tank.

Plastic jacket 17 can be fixed to ceramic edge protector 14 by adhesion, vulcanization or fusion welding technique. Besides just adhesion, jacket 17 is expediently connected to edge protector 14 with positive locking. This is done preferably by having jacket 17 also engage with the supports at side edges 2*c* of the cathode sheet 16.

Figure 4:
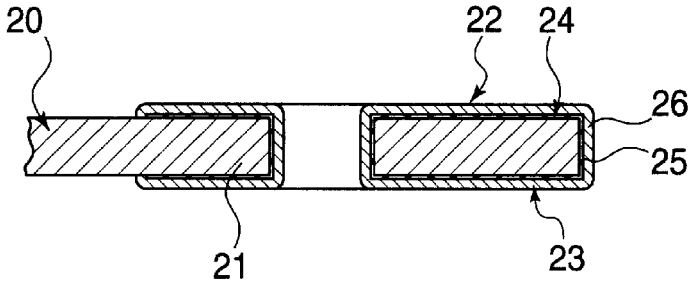
FIG. 4 a fourth specific embodiment of a metal cathode sheet in horizontal section through the inside edge.

FIG. 4 shows a cathode sheet 20, which corresponds to the basic construction of cathode sheets 1*a*, 1*b*, 1*c*. It shows a inside edge 21 having an edge protector 22 made of a polymeric multi-layer system 23. The polymeric multi-layer system 23 is made of a half layer 24 having embedded metal components 25 so as to increase adhesion by physical-chemical interaction, and a protective layer 26 made of a polymeric material. Adhesive layer 24 adheres by a direct physical-chemical interaction of metal components 25 and the surface of cathode sheet 20 made of stainless steel. As compared to known edge protection systems, the connection generates substantially higher and improved cohesive forces.

A third attainment of the object is a cathode sheet having, an edge protector at the side edges which is constructed in multiple layers, at least one layer being made of a ceramic material, on which there is at least one further layer made of a polymeric material.

In particular, the use of rubber-elastic polymer materials as cover layer avoids in an advantageous manner the mechanical influences, appearing during stripping off, on the basis layer made of a ceramic material.

Edge protector 3, 8, 14, 22 of all the specific embodiments described above preferably has a medium thickness between 0.1 mm and 0.8 mm, particularly between 0.3 mm and 0.5 mm.

In all instances, the edge protection can be applied to the side edges in fluid or powder form. After hardening, stable adhesion results. It is also possible to coat the side edges with a ceramic material in a gaseous or vapor condition. In practice, the application of the edge protection by using a sintering technique is available. Depending on the material, dip enameling, laser coating or powder coating can also be applied.

The edge protection is electrically insulating, of dense porosity and resistant to electrolyte. Preferably, the ceramic material used is aluminum, zirconium or magnesium oxide. The edge protection has an absolutely fluid-tight intimate connection to the cathode sheet. Flux line concentrations at exposed metal edges can thus be reliably avoided. Metallic buds are thus forestalled. Waxing and dewaxing the edge regions is not required.

The multiple layer system can further be constructed from at least two layers of various polymeric materials.

For practical purposes, it is regarded as particularly advantageous to use rubber-elastic polymer materials. These are resistant to mechanical influences which appear during stripping off of the recovered pure copper.

According to the features of claim 10, the thickness of the edge protector is between 0.1 mm and 0.8 mm. A thickness of 0.3 mm to 0.5 mm is regarded as particularly advantageous. At this thickness the electrical insulation, pore density and resistance to electrolyte are reliably ensured. Beyond that, the edge protector is flexible enough to be able to stand deformations or mechanical shocks during stripping off of the recovered pure copper.

What is claimed is:

1. A metal cathode sheet an edge protector, said sheet provided at least at its side edges with an edge protector, said protector made of a ceramic material.

2. The cathode sheet recited in claim 1 wherein said ceramic material is selected from the group consisting of aluminum oxide, zirconium oxide, or magnesium oxide

3. The cathode sheet recited in claim 1 wherein said sheet is a component of cathode equipment for an electrolysis tank for electrolytic recovery of pure metals, especially copper, and wherein the side edges come into contact with the electrolyte and are vertically aligned in the electrolysis tank.

4. The cathode sheet as recited in claim 1, wherein the edge protector has a multi-layer construction.

5. The cathode sheet as recited in claim 1, wherein the edge protector is made of a half layer and a cover layer.

6. The cathode sheet as recited in claim 1, wherein, in a region of the side edges, supports are provided for the edge protector.

7. The cathode sheet as recited in claim 1, wherein the edge protector further comprises a jacket made of plastic.

8. The cathode sheet as recited in claim 7, wherein the jacket is connected to the edge protector using at least one of non-positive and positive locking.

9. The cathode sheet as recited in claim 1, wherein metal components are embedded in the half layer.

10. The cathode sheet as recited in claim 1, wherein the edge protector has a thickness between about 0.1 mm and 0.8 mm.

11. The cathode sheet as recited in claim 10, wherein the thickness is further defined between about 0.3 mm and 0.5 mm.

12. A metal cathode sheet as a component of cathode equipment for an electrolysis tank for the electrolytic recovery of pure metals, especially copper, which is provided, at least at its side edges which come into contact with the electrolyte and are vertically aligned in the electrolysis tank, with an edge protector, wherein the edge protector has a multi-layer construction, at least one layer being made of a ceramic material on which there is at least one further layer made of a polymeric material.

* * * * *